US008253000B1

(12) United States Patent
Martin

(10) Patent No.: US 8,253,000 B1
(45) Date of Patent: Aug. 28, 2012

(54) CHORD BAR SYSTEM FOR STRINGED MUSICAL INSTRUMENTS

(76) Inventor: Roy Dale Martin, Cleveland, TN (US)

( * ) Notice: Subject to any disclaimer, the term of this patent is extended or adjusted under 35 U.S.C. 154(b) by 164 days.

(21) Appl. No.: 12/854,966

(22) Filed: Aug. 12, 2010

(51) Int. Cl.
*G10D 3/00* (2006.01)

(52) U.S. Cl. ..... 84/317

(58) Field of Classification Search ..... 84/315–319, 84/267, 199, 214, 285–290
See application file for complete search history.

(56) References Cited

U.S. PATENT DOCUMENTS 7,767,902 B2 * 8/2010 Ludwig ..... 84/741

* cited by examiner

*Primary Examiner* — Kimberly Lockett
(74) *Attorney, Agent, or Firm* — Luedeka Neely Group, PC

(57) ABSTRACT

A chord bar system for stringed musical instruments. The chord bar system enables a single finger movement pattern may be used in pressing the buttons to play each I-IV-V chord progression in each different key.

14 Claims, 3 Drawing Sheets

CHORD BAR SYSTEM FOR STRINGED MUSICAL INSTRUMENTS

FIELD

This disclosure relates to the field of stringed musical instruments. More particularly, this disclosure relates to a chord bar system for stringed musical instruments that enables the playing of different chords by use of a single finger movement.

BACKGROUND

Stringed musical instruments produce sound from vibrating strings communicated to the air by the body of the instrument. Desired sounds are made by controlling which strings vibrate. An autoharp or chorded zither is a type of stringed musical instrument that has a series of chord bars attached to dampers which contact desired ones of the strings to keep them from vibrating, while the strings are strummed.

Typically, an autoharp has a plurality of strings, often 36 and a chord bar configured to play from about 12 to 21 chords by having 12 to 21 chord bars. Chords represent desired sounds and correspond to sets of harmonically-related notes. There are various types of chords, such as major and minor chords, and such chords are demarked to pitch classes. In an autoharp, pressing a chord bar depresses a damper to keep all the strings from vibrating except those that form a desired chord. Each chord typically requires a unique finger movement to play that chord. Learning multiple finger movements to be able to play multiple chords takes extensive practice. Accordingly, improvement is desired in the provision of a chord bar system that reduces the complexity of playing different chords.

The present disclosure provides a chord bar system for stringed musical instruments that enables the playing of different chords by use of a single finger movement.

SUMMARY

The above and other needs are met by a chord bar system for stringed musical instruments. The chord bar system enables a single finger movement pattern may be used in pressing the buttons to play each I-IV-V chord progression in each different key.

In this regard, the disclosure relates to a stringed musical instrument having a body; a plurality of strings stretched across the body; and a plurality of chord bars yieldably supported adjacent the strings. Each chord bar has one or more dampers for contacting one or more of the strings when the chord bar is urged toward the strings. Strings that are not contacted by a damper together generate a musical chord when the strings are made to vibrate. The instrument also includes a plurality of buttons, each connected to a corresponding one of the plurality of chord bars, such that when a button is pressed, a corresponding chord bar is urged toward the strings. The buttons are arranged in multiple groupings to provide multiple standard I-IV-V chord progressions in multiple different keys, and a single finger movement pattern may be used in pressing the buttons to play each I-IV-V chord progression in each different key.

Instruments according to the disclosure advantageously enable the playing of different chords by use of a single finger movement.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
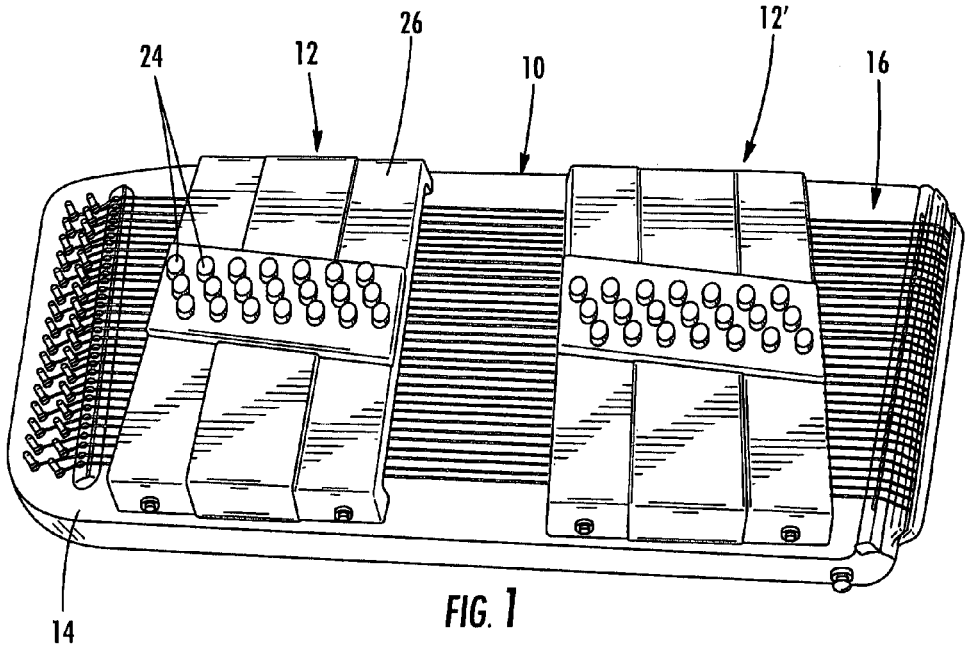
FIG. 1 is a perspective view of an autoharp having a chord bar system according to the disclosure.
Figure 2:
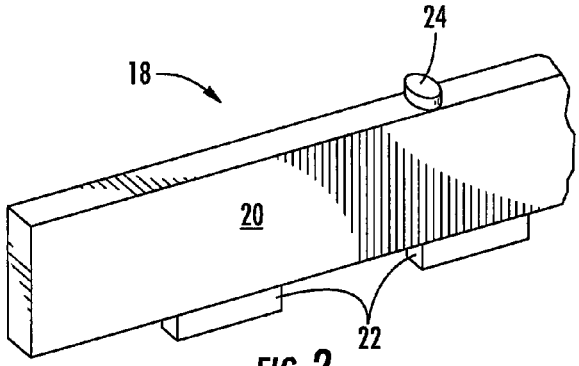
FIG. 2 shows a chord bar of the chord bar system of the autoharp of FIG. 1.

With reference to the drawings, the disclosure relates to a chorded zither or autoharp 10 including a chord bar system 12 according to the disclosure. The autoharp 10 is shown having a second chord bar system 12' for improved sound selection, it being understood that the autoharp 10 with just the chord bar system 12 is fully functional for the purpose of enabling different chords to be played by use of a single finger movement. The addition of the second chord bar system 12' is also configured to enable the playing of different chords with a single finger movement and the inclusion of the second chord bar system 12' is advantageous to permit the playing of flats. It will be understood that while the disclosure describes the chord bar system in relation to an autoharp, the chord bar system may be utilized with other stringed instruments of the type utilizing keys.

The autoharp 10 includes a body 14 across which are stretched a plurality of music strings 16, preferably twenty-one of the strings 16 in number, although other numbers may be utilized. The chord bar system 12 includes a plurality of chord bars 18, there being one chord bar per each of the strings 16. Each chord bar 18 is provided by a bar 20 having one or more dampers 22 provided as by felt pads mounted on the lower surface of the bar 20 such that when the bar 20 is depressed, the damper 22 or dampers 22 contacts predetermined ones of the strings 16 to keep such string or strings from vibrating. A button or key 24 is disposed on the upper surface of the bar 20 for being contacted by the finger of a user for depressing the bar.

The chord bars 18 are surrounded by a housing 26, with the keys 24 extending through apertures of the housing 26. The bars 20 are resiliently supported over the strings 16 by the housing 26 as by springs, such as, for example, coil springs, disposed and operatively associated with the housing 26 to yieldably position the bars 20 above the strings 16, yet permit the bars 20 to be depressed so as to contact the dampers 22 with the strings 16 and to return to the raised position when released.

Figure 3:
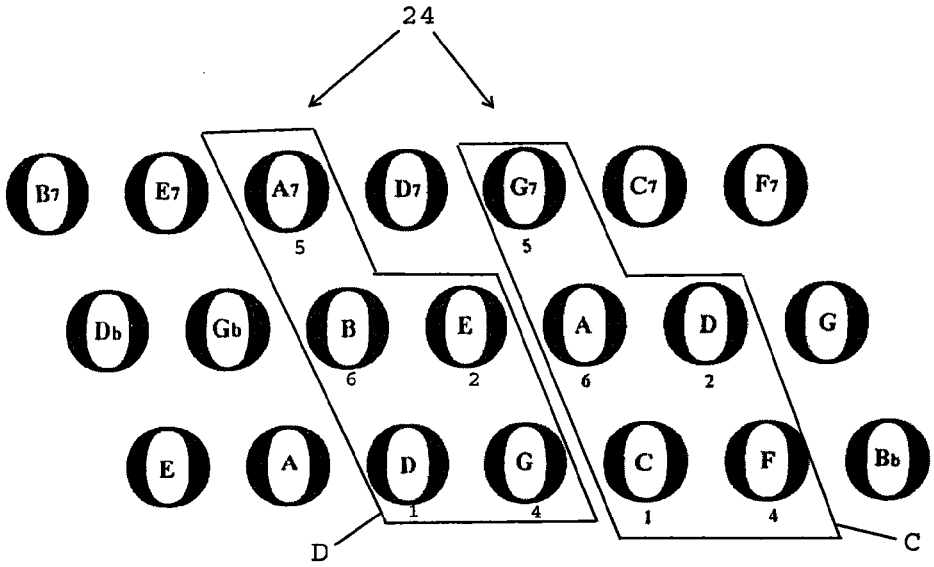
FIG. 3 shows arrangement of keys of the chord bar system of the autoharp of FIG. 1 which enables different chords to be played by use of a single finger movement.

The keys 24 are advantageously arranged according to the disclosure such that different chords may be played by use of a single finger movement. For example, with reference to FIG. 3, the keys 24 are arranged to use the same three-finger pattern to play in any and every chord. In FIG. 3, finger movement numbers 1, 4, 5, 2, and 6 are shown for the chord of C, indicated by box C. A standard I-IV-V chord progression in the key of C, consists of three chords: the C Major chord, the F Major chord, and the G Dominant Seventh (G7) chord. Additional chords, for harmony, include the D Major chord (#2) and A Major chord (#6), are also provided.

To play this progression using the autoharp 10, the middle finger of a user is used for the lead chord of C Major (#1); the ring finger is used for the F Major chord (#4); and the index finger is used for the G7 chord (#5). To play the harmonies, the ring finger slides from position #4 to #2 and the middle finder slides from position #1 to position #6. The middle finger is always used for the lead chord and each chord progression uses the same numbered pattern of 1, 4, 5, 2, and 6, and the same finger movements as for the chord of C. In this regard, once a single three-finger pattern has been learned, this same pattern may be used for all chords.

In another example, the I-IV-V chord progression in the key of D consists of the D Major, G Major and the A7 chords. Additionally, the harmonies include the E Major and B Major chords. This second chord progression can be played using the same hand position and using the same 1, 4, 5, 2, and 6 pattern as before, indicated by box D.

Figure 4:
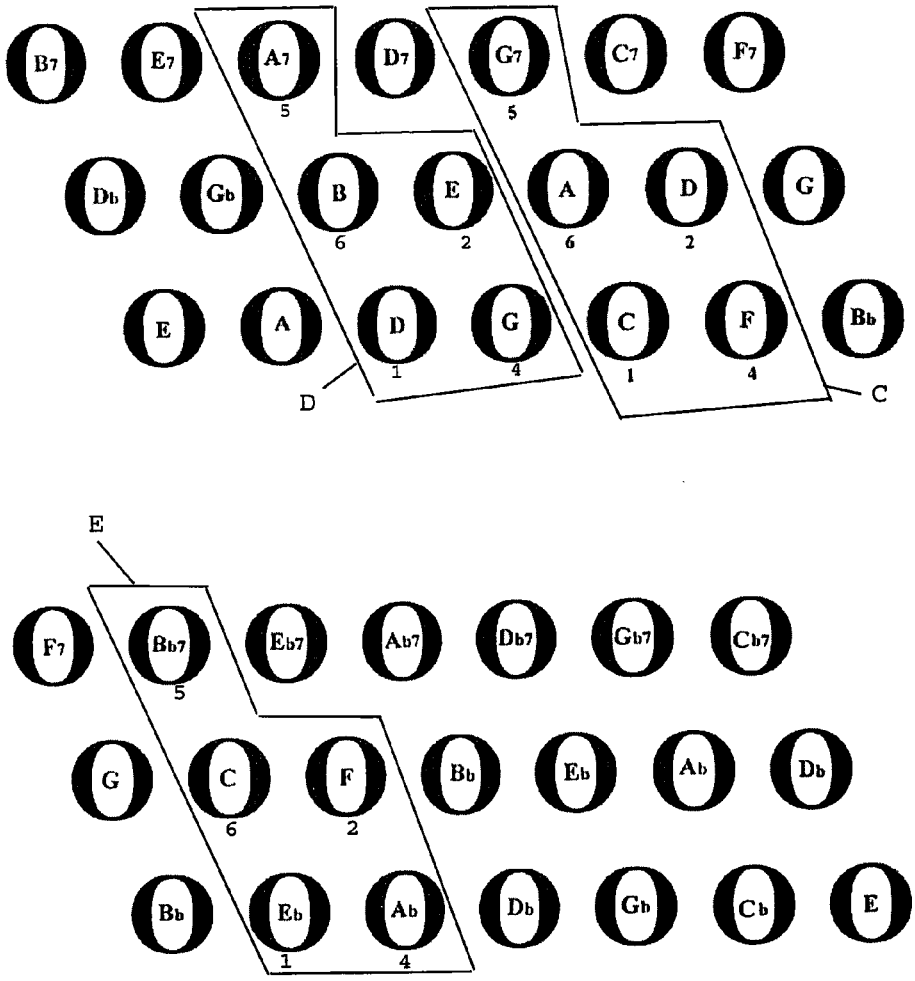
FIG. 4 shows the keys of the chord bar system of FIG. 3 in conjunction with the keys of a second chord bar system of the autoharp of FIG. 1.

As seen in FIG. 4, a second chord bar system 12' having a similar construction and key arrangement as the first chord bar system 12, may be optionally used to increase the number of chords available. As with the first chord bar system, chords are played on the second chord bar system using the same three-finger pattern. Accordingly, the second chord bar system increases the variety of chords available while maintaining ease of use. For example, when playing the I-IV-V chord progression in the key of E Flat Major, consisting of the E Flat Major chord the A Flat Major chord and the B Flat Dominant Seventh (B Flat 7) chord, the same three-finger pattern may be used, indicated by box E.

Accordingly, it will be appreciated that the chord bar system 12 advantageously enables the playing of different chords by use of a single finger movement.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A stringed musical instrument, comprising:

a body;

a plurality of strings stretched across the body;

a plurality of chord bars yieldably supported adjacent the strings, each chord bar having one or more dampers for contacting one or more of the strings when the chord bar is urged toward the strings, wherein strings that are not contacted by a damper together generate a musical chord when the strings are made to vibrate; and a plurality of buttons, each connected to a corresponding one of the plurality of chord bars, such that when a button is pressed, a corresponding chord bar is urged toward the strings, wherein the buttons are arranged in multiple groupings to provide multiple standard I-IV-V chord progressions in multiple different keys, and wherein a single finger movement pattern may be used in pressing the buttons to play each I-IV-V chord progression in each different key.

2. The stringed musical instrument of claim 1, wherein a first grouping of buttons provides a standard I-IV-V chord progression in a key of E Major, a second grouping of buttons provides a standard I-IV-V chord progression in a key of A Major, a third grouping of buttons provides a standard I-IV-V chord progression in a key of D Major, a fourth grouping of buttons provides a standard I-IV-V chord progression in a key of G Major, a fifth grouping of buttons provides a standard I-IV-V chord progression in a key of C Major, and a sixth grouping of buttons provides a standard I-IV-V chord progression in a key of F Major.

3. The stringed musical instrument of claim 2, wherein the first grouping of buttons overlaps and has buttons in common with the second grouping of buttons, the second grouping of buttons overlaps and has buttons in common with the third grouping of buttons, the third grouping of buttons overlaps and has buttons in common with the fourth grouping of buttons, the fourth grouping of buttons overlaps and has buttons in common with the fifth grouping of buttons, and the fifth grouping of buttons overlaps and has buttons in common with the sixth grouping of buttons.

4. The stringed musical instrument of claim 2, wherein the buttons include at least two buttons that each provides an E Major chord, with one of the two buttons included in the first grouping of buttons, and the other of the two buttons included in the third and fourth grouping of buttons.

5. The stringed musical instrument of claim 2, wherein the buttons include at least two buttons that each provides an A Major chord, with one of the two buttons included in the second grouping of buttons, and the other of the two buttons included in the fourth and fifth grouping of buttons.

6. The stringed musical instrument of claim 2, wherein the buttons include at least two buttons that each provides a D Major chord, with one of the two buttons included in the third grouping of buttons, and the other of the two buttons included in the fifth and sixth grouping of buttons.

7. The stringed musical instrument of claim 2, wherein the buttons include at least two buttons that each provides a G Major chord, with one of the two buttons included in the fourth grouping of buttons, and the other of the two buttons included in the sixth grouping of buttons.

8. The stringed musical instrument of claim 2, wherein a seventh grouping of buttons provides a standard I-IV-V chord progression in a key of B Flat Major, an eighth grouping of buttons provides a standard I-IV-V chord progression in a key of E Flat Major, a ninth grouping of buttons provides a standard I-IV-V chord progression in a key of A Flat Major, a tenth grouping of buttons provides a standard I-IV-V chord progression in a key of D Flat Major, an eleventh grouping of buttons provides a standard I-IV-V chord progression in a key of G Flat Major, and a twelfth grouping of buttons provides a standard I-IV-V chord progression in a key of C Flat Major.

9. The stringed musical instrument of claim 8, wherein the first, second, third, fourth, fifth, and sixth groupings of buttons are provided in a first chord bar system disposed over the strings, and wherein the seventh, eighth, ninth, tenth, eleventh, and twelfth groupings of buttons are provided in a second chord bar system disposed over the strings.

10. The stringed musical instrument of claim 1 wherein the buttons include at least twenty-one buttons arranged in at least three rows including a bottom row, a middle row, and a top row, and in at least seven columns including a first column, a second column, a third column, a fourth column, a fifth column, a sixth column, and a seventh column, and wherein a button for an E Major chord is disposed in the bottom row and first column, a button for an A Major chord is disposed in the bottom row and second column, a button for a D Major chord is disposed in the bottom row and third column, a button for a G Major chord is disposed in the bottom row and fourth column, a button for a C Major chord is disposed in the bottom row and fifth column, a button for an F Major chord is disposed in the bottom row and sixth column, a button for a B Flat Major chord is disposed in the bottom row and seventh column, a button for a D Flat Major chord is disposed in the middle row and first column, a button for a G Flat Major chord is disposed in the middle row and second column, a button for a B Major chord is disposed in the middle row and third column, a button for an E Major chord is disposed in the middle row and fourth column, a button for an A Major chord is disposed in the middle row and fifth column, a button for a D Major chord is disposed in the middle row and sixth column, a button for a G Major chord is disposed in the middle row and seventh column, a button for a B Seventh chord is disposed in the top row and first column, a button for an E Seventh chord is disposed in the top row and second column, a button for an A Seventh chord is disposed in the top row and third column, a button for a D Seventh chord is disposed in the top row and fourth column, a button for a G Seventh chord is disposed in the top row and fifth column, a button for a C Seventh chord is disposed in the top row and sixth column, and a button for an F Seventh chord is disposed in the top row and seventh column.

11. The stringed musical instrument of claim 2, wherein the first grouping of buttons includes a button for an E Major chord, a button for an A Major chord, a button for a D Flat Major chord, a button for a G Flat Major chord, and a button for a B Seventh chord, the second grouping of buttons includes a button for an A Major chord, a button for a D Major chord, a button for a G Flat Major chord, a button for a B Major chord, and a button for an E Seventh chord, the third grouping of buttons includes a button for an D Major chord, a button for a G Major chord, a button for a B Major chord, a button for an E Major chord, and a button for an A Seventh chord, the fourth grouping of buttons includes a button for a G Major chord, a button for a C Major chord, a button for an E Major chord, a button for an A Major chord, and a button for a D Seventh chord, the fifth grouping of buttons includes a button for a C Major chord, a button for an F Major chord, a button for an A Major chord, a button for a D Major chord, and a button for a G Seventh chord, and the sixth grouping of buttons includes a button for an F Major chord, a button for a B Flat Major chord, a button for a D Major chord, a button for a G Major chord, and a button for a C Seventh chord.

12. The stringed musical instrument of claim 8, wherein the seventh grouping of buttons includes a button for a B Flat Major chord, a button for an E Flat Major chord, a button for a G Major chord, a button for a C Major chord, and a button for an F Seventh chord, the eighth grouping of buttons includes a button for an E Flat Major chord, a button for an A Flat Major chord, a button for a C Major chord, a button for an F Major chord, and a button for a B Flat Seventh chord, the ninth grouping of buttons includes a button for an A Flat Major chord, a button for a D Flat Major chord, a button for an F Major chord, a button for a B Flat Major chord, and a button for an E Flat Seventh chord, the tenth grouping of buttons includes a button for a D Flat Major chord, a button for a G Flat Major chord, a button for a B Flat Major chord, a button for an E Flat Major chord, and a button for an A Flat Seventh chord, the eleventh grouping of buttons includes a button for a G Flat Major chord, a button for a C Flat Major chord, a button for an E Flat Major chord, a button for an A Flat Major chord, and a button for a D Flat Seventh chord, and the twelfth grouping of buttons includes a button for a C Flat Major chord, a button for an E Major chord, a button for an A Flat Major chord, a button for a D Flat Major chord, and a button for a G Flat Seventh chord.

13. A stringed musical instrument, comprising:

a body;

a plurality of strings stretched across the body;

a plurality of chord bars yieldably supported adjacent the strings, each chord bar having one or more dampers for contacting one or more of the strings when the chord bar is urged toward the strings, wherein strings that are not contacted by a damper together generate a musical chord when the strings are made to vibrate; and a plurality of buttons, each connected to a corresponding one of the plurality of chord bars, such that when a button is pressed, a corresponding chord bar is urged toward the strings, wherein the buttons are arranged in multiple groupings including:

a first grouping of buttons that provides a standard I-IV-V chord progression in a key of E Major, a second grouping of buttons that provides a standard I-IV-V chord progression in a key of A Major, a third grouping of buttons that provides a standard I-IV-V chord progression in a key of D Major, a fourth grouping of buttons that provides a standard I-IV-V chord progression in a key of G Major, a fifth grouping of buttons that provides a standard I-IV-V chord progression in a key of C Major, and a sixth grouping of buttons that provides a standard I-IV-V chord progression in a key of F Major, wherein a single finger movement pattern may be used in pressing the buttons to play each I-IV-V chord progression in each different key.

14. A stringed musical instrument, comprising:

a body;

a plurality of strings stretched across the body;

a plurality of chord bars yieldably supported adjacent the strings, each chord bar having one or more dampers for contacting one or more of the strings when the chord bar is urged toward the strings, wherein strings that are not contacted by a damper together generate a musical chord when the strings are made to vibrate; and a plurality of buttons, each connected to a corresponding one of the plurality of chord bars, such that when a button is pressed, a corresponding chord bar is urged toward the strings, wherein the plurality of buttons include at least twenty-one buttons arranged in at least three rows including a bottom row, a middle row, and a top row, and in at least seven columns including a first column, a second column, a third column, a fourth column, a fifth column, a sixth column, and a seventh column, and wherein a button for an E Major chord is disposed in the bottom row and first column, a button for an A Major chord is disposed in the bottom row and second column, a button for a D Major chord is disposed in the bottom row and third column, a button for a G Major chord is disposed in the bottom row and fourth column, a button for a C Major chord is disposed in the bottom row and fifth column, a button for an F Major chord is disposed in the bottom row and sixth column, a button for a B Flat Major chord is disposed in the bottom row and seventh column, a button for a D Flat Major chord is disposed in the middle row and first column, a button for a G Flat Major chord is disposed in the middle row and second column, a button for a B Major chord is disposed in the middle row and third column, a button for an E Major chord is disposed in the middle row and fourth column, a button for an A Major chord is disposed in the middle row and fifth column, a button for a D Major chord is disposed in the middle row and sixth column, a button for a G Major chord is disposed in the middle row and seventh column, a button for a B Seventh chord is disposed in the top row and first column, a button for an E Seventh chord is disposed in the top row and second column, a button for an A Seventh chord is disposed in the top row and third column, a button for a D Seventh chord is disposed in the top row and fourth column, a button for a G Seventh chord is disposed in the top row and fifth column, a button for a C Seventh chord is disposed in the top row and sixth column, and a button for an F Seventh chord is disposed in the top row and seventh column.

* * * * *